US010436547B2

(12) United States Patent
Tseng

(10) Patent No.: US 10,436,547 B2
(45) Date of Patent: Oct. 8, 2019

(54) FIRING RATE SETTING MECHANISM OF AIRSOFT GUN

(71) Applicant: Jui-Fu Tseng, Yilan (TW)

(72) Inventor: Jui-Fu Tseng, Yilan (TW)

( * ) Notice: Subject to any disclaimer, the term of this patent is extended or adjusted under 35 U.S.C. 154(b) by 0 days.

(21) Appl. No.: 16/183,761

(22) Filed: Nov. 8, 2018

(65) Prior Publication Data

US 2019/0072359 A1 Mar. 7, 2019

(51) Int. Cl.
*F41B 11/71* (2013.01)
*F41B 11/62* (2013.01)

(52) U.S. Cl.
CPC ..... *F41B 11/71* (2013.01); *F41B 11/62* (2013.01)

(58) Field of Classification Search
CPC ..... F41B 11/71; F41B 11/62
USPC ..... 124/72
See application file for complete search history.

(56) References Cited

U.S. PATENT DOCUMENTS 6,857,422 B2 * 2/2005 Pedicini ..... F04B 9/02 124/63
8,360,042 B2 * 1/2013 Skilling ..... F41A 1/06 124/71
2005/0000505 A1 * 1/2005 Pedicini ..... F04B 9/02 124/63
2005/0188974 A1 * 9/2005 Pedicini ..... F04B 9/02 124/65
2015/0040880 A1 * 2/2015 Tseng ..... F41B 11/62 124/71
2018/0356178 A1 * 12/2018 Chu ..... F41B 11/642

* cited by examiner

*Primary Examiner* — Joshua E Freeman

(57) ABSTRACT

An electrically powered airsoft gun includes a rechargeable battery; an indicator; an air canister; a solenoid valve for opening or closing the air canister; an electronic circuit board electrically connected to the rechargeable battery and including a microswitch and a processor electrically connected to the indicator and the solenoid vale respectively; and a trigger for activating or deactivating the microswitch. Various firing rates or intervals can be set by pulling the trigger a number of times.

3 Claims, 6 Drawing Sheets

FIRING RATE SETTING MECHANISM OF AIRSOFT GUN

BACKGROUND OF THE INVENTION

1. Field of the Invention

The invention relates to airsoft guns and more particularly to a firing rate setting mechanism of an electrically powered airsoft gun having improved characteristics.

2. Description of Related Art

A conventional electrically-controlled pneumatic paintball gun is provided with a pressure regulator for regulating gas from a high pressure source into a low pressure gas; a firing valve assembly for receiving the low pressure gas from the pressure regulator and for transmitting the low pressure gas to a firing chamber during a firing operation; and an electrically-controlled solenoid valve for operating a pneumatic ram assembly using the low pressure gas in which the pneumatic ram assembly controls a firing operation to launch a paintball from the firing chamber.

While the device enjoys its success in the market, continuing improvements in the exploitation of electrically powered paintball gun of this type are constantly being sought.

SUMMARY OF THE INVENTION

It is therefore one object of the invention to provide an electrically powered airsoft gun, comprising a power source; an indicator; an air canister; a solenoid valve for opening or closing the air canister; an electronic circuit board electrically connected to the power source and including a microswitch and a processor electrically connected to the indicator and the solenoid vale respectively; and a trigger for activating or deactivating the microswitch.

The above and other objects, features and advantages of the invention will become apparent from the following detailed description taken with the accompanying drawings.

DETAILED DESCRIPTION OF THE INVENTION

Figure 1:
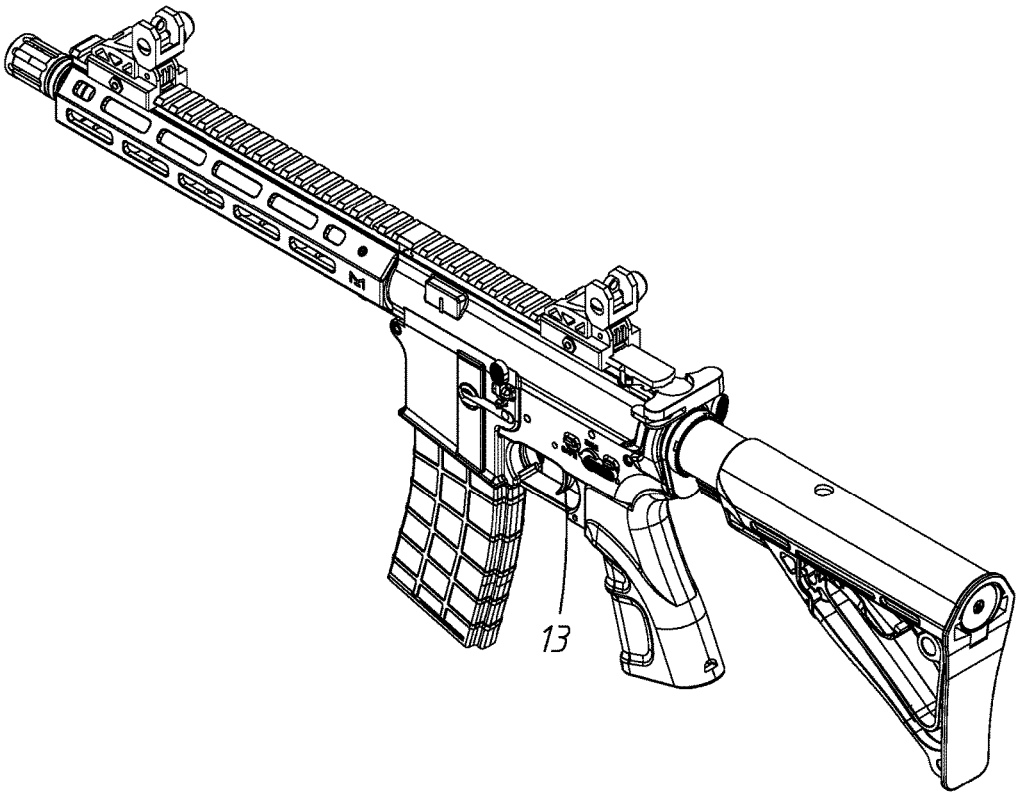
FIG. 1 is a perspective view of an airsoft gun according to the invention.
Figure 2:
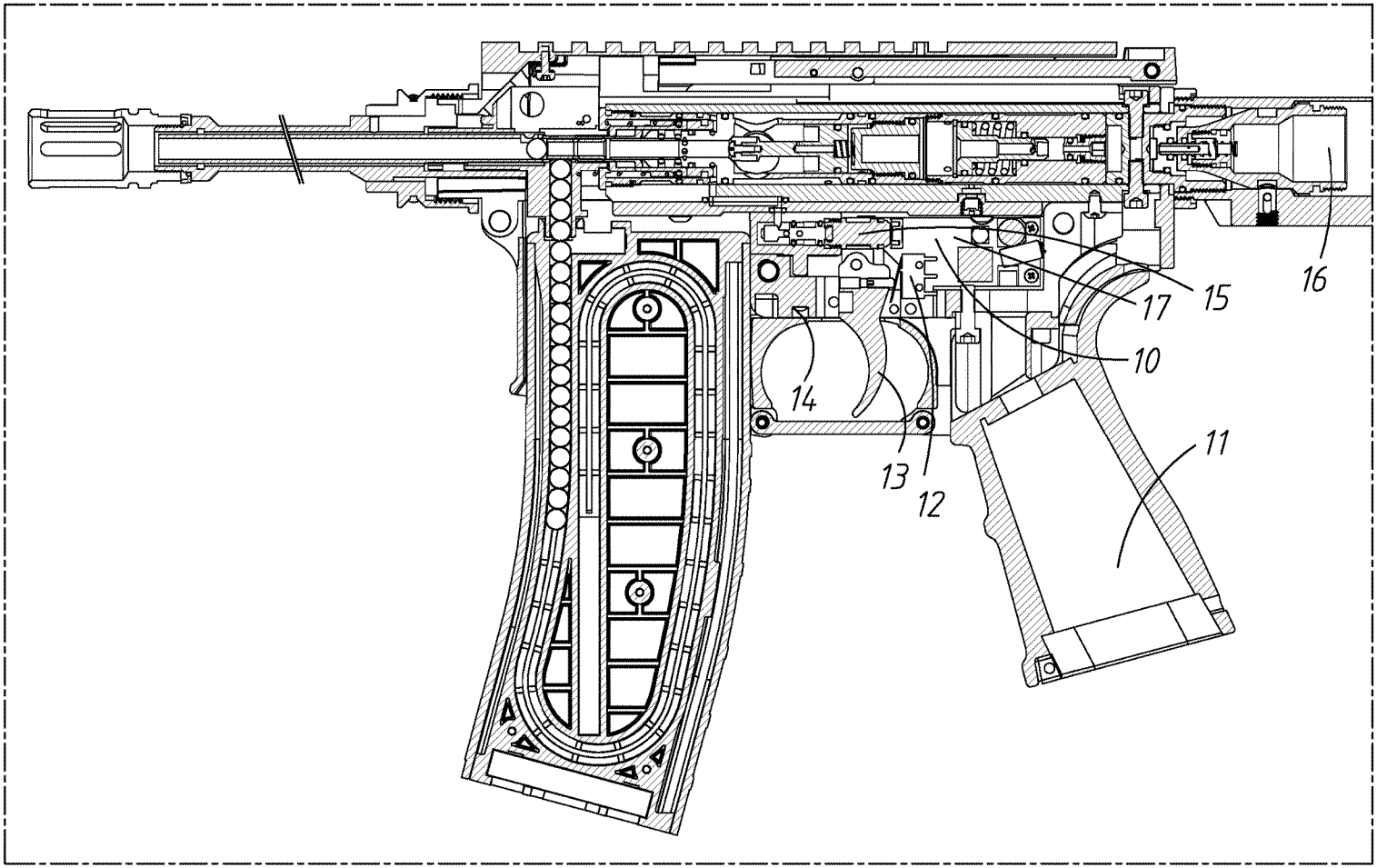
FIG. 2 is a longitudinal sectional view of FIG. 1 showing a first preferred embodiment of the airsoft gun.
Figure 3:
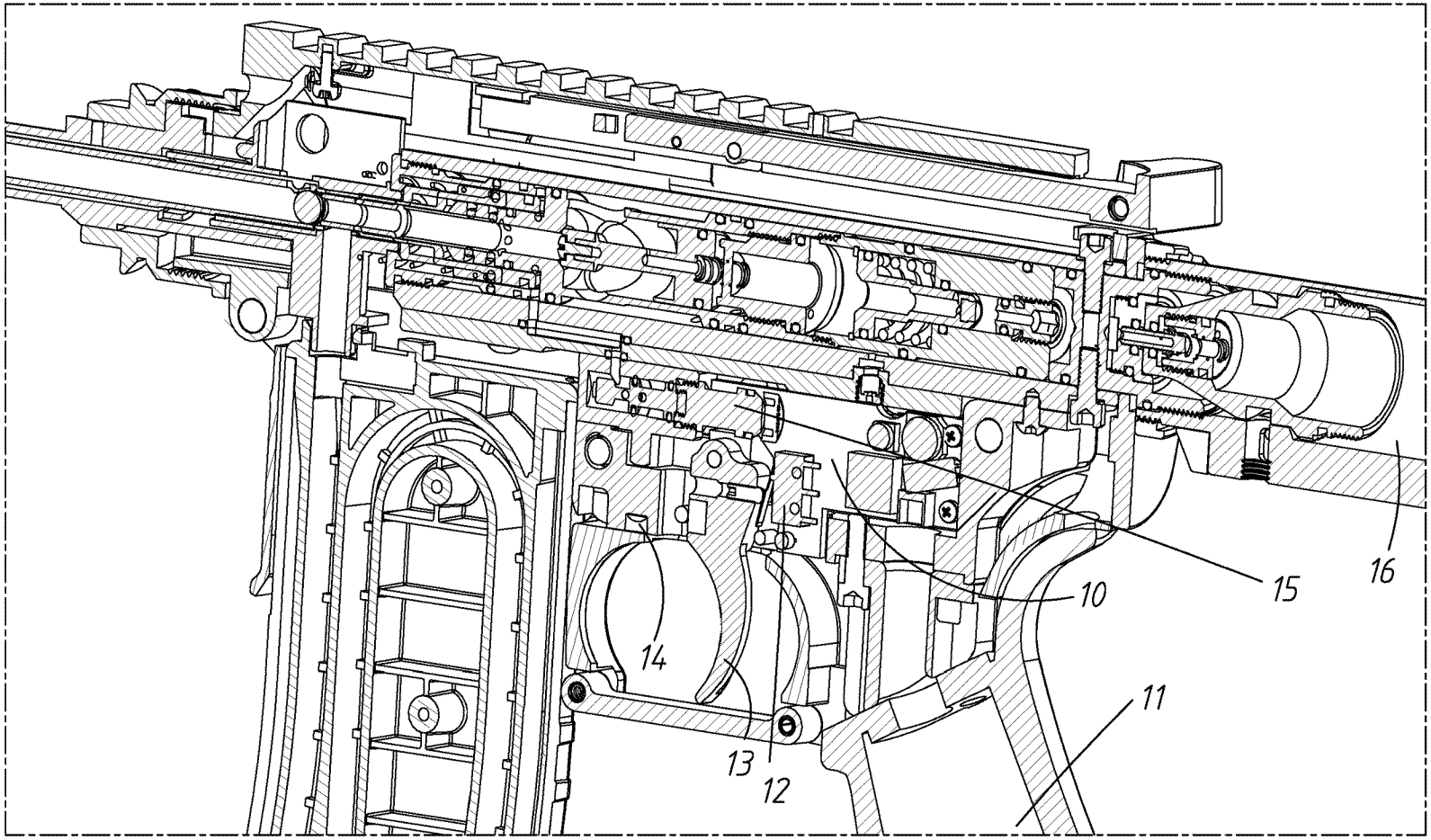
FIG. 3 is a fragmentary view of FIG. 2.
Figure 4:
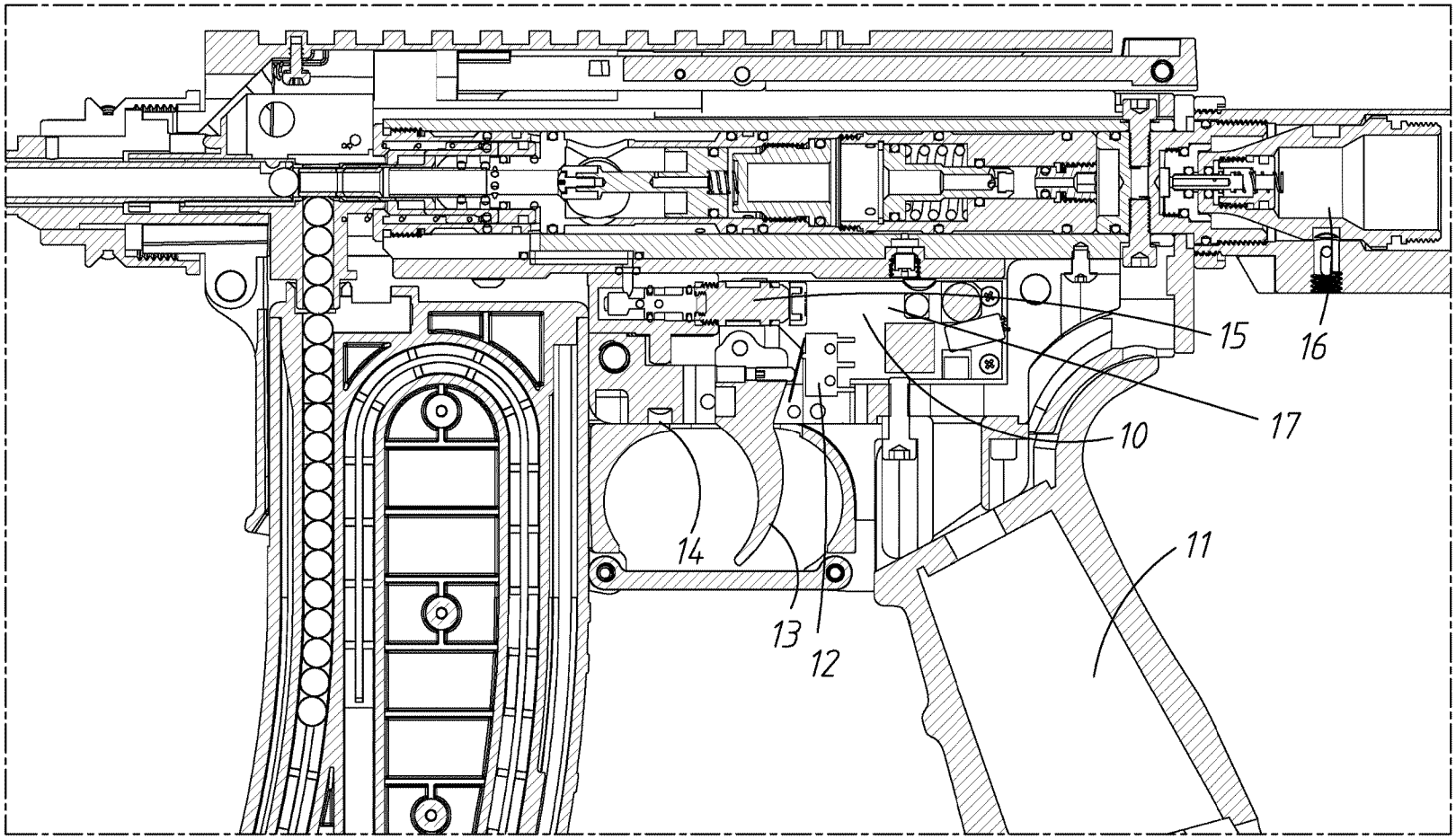
FIG. 4 is a side view of FIG. 3.
Figure 5:
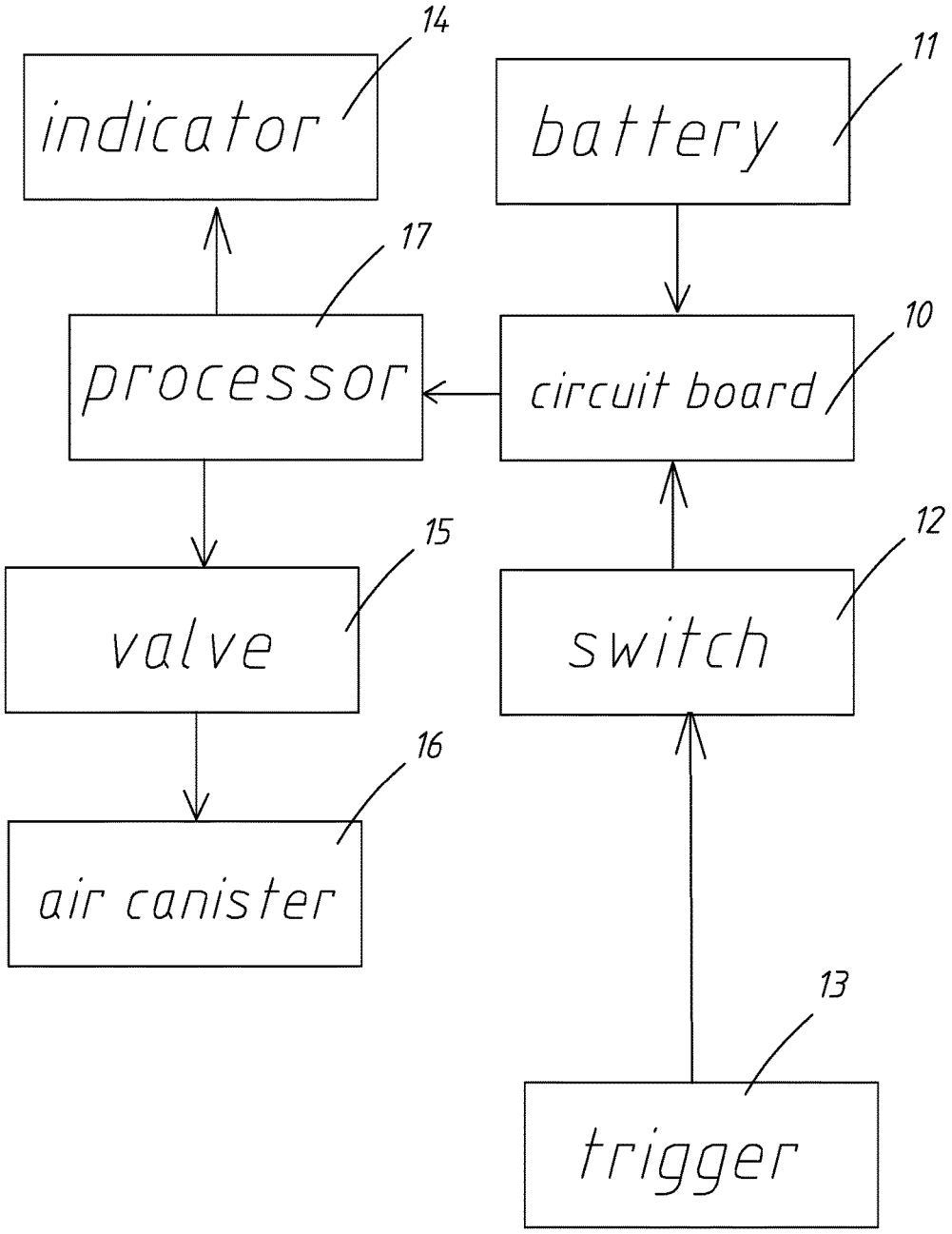
FIG. 5 is a block diagram of the first preferred embodiment of the airsoft gun.

Referring to FIGS. 1 to 5, an airsoft gun in accordance with the invention comprises the following components as discussed in detail below.

A rechargeable battery 11 is provided in a grip. An electronic circuit board 10 is provided in a gun body and electrically connected to the battery 11. A switch (e.g., microswitch) 12 and a processor (e.g., microprocessor) 17 are provided on the electronic circuit board 10. The processor 17 can program varying firing rates and send same to a valve (e.g., solenoid valve) 15 for activation. After being turned on, the valve 15 activates an air canister 16 in a gunstock to supply pressurized air to a firing mechanism. As a result, at least one metallic ball projectile is shot.

An indicator 14 is provided on the gun body adjacent to a trigger 13 and electrically connected to the processor 17. A firing rate such as semi-automatic, 3 or 6 shot burst, turbo, or full-automatic is indicated by the indicator 14.

A firing operation of the airsoft gun is described below. An individual may pull the trigger 13 to turn on the switch 12. And in turn, the indicator 14 is activated to change a basic firing mode of shooting 12 shots continuously to a second firing mode of shooting 20 shots continuously. A further activation of the trigger 13 changes the second firing mode of shooting 20 shots continuously to a third firing mode of shooting 40 shots continuously by flashing the indicator 14 a predetermined number of times. A still further activation of the trigger 13 changes the third firing mode of shooting 40 shots continuously to a fourth firing mode of shooting 60 shots continuously by flashing the indicator 14 a predetermined number of times. Above firing rates can be programmed per the individual's desire.

Figure 6:
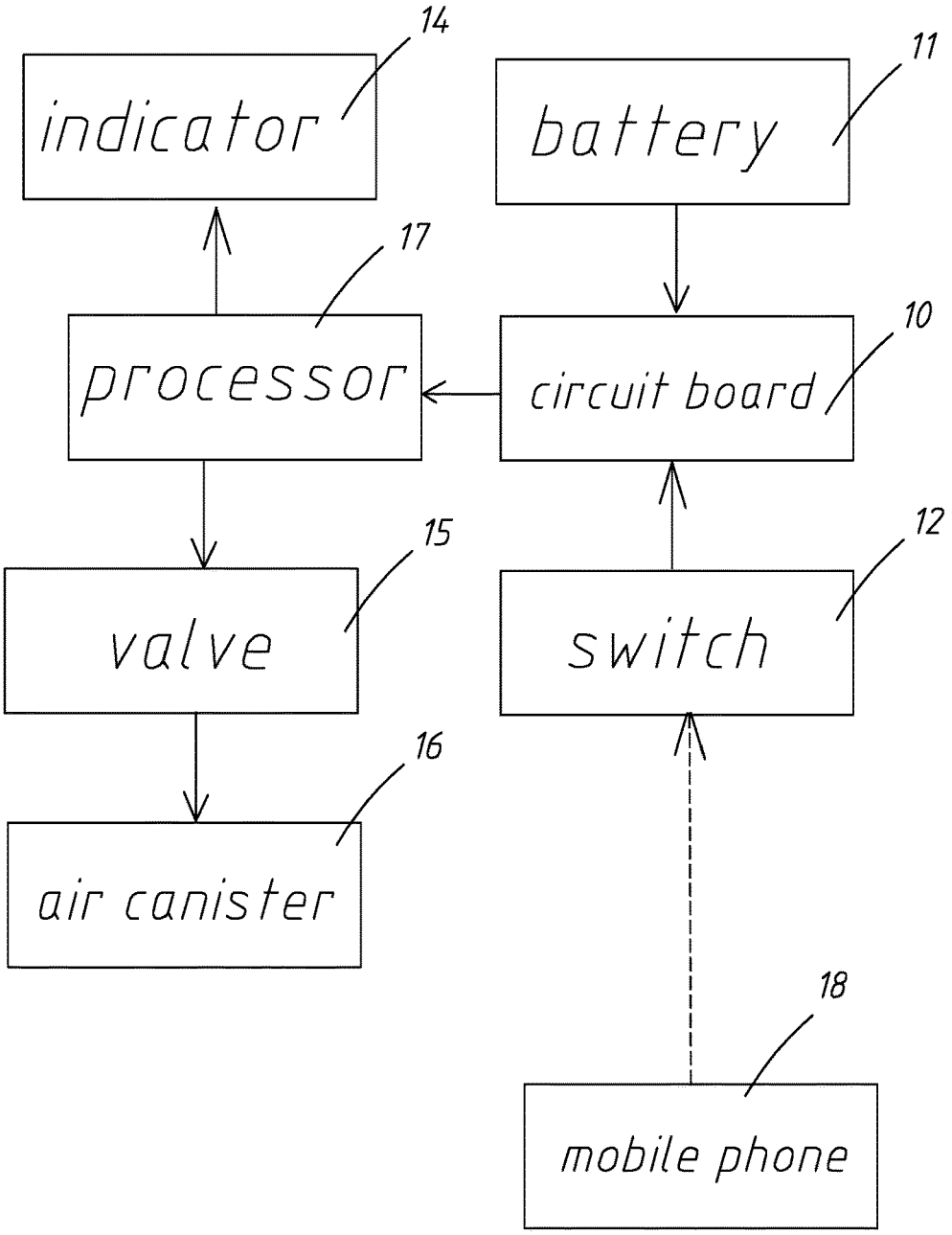
FIG. 6 is a block diagram of a second preferred embodiment of the airsoft gun according to the invention.

Referring to FIG. 6, an airsoft gun in accordance with a second preferred embodiment of the invention is shown. The characteristics of the second preferred embodiment are substantially the same as that of the first preferred embodiment except the following: A mobile phone 18 (or a remote control) is used to activate switch 12. And in turn, the valve 15 is activated (i.e., open) by the processor 17. Further, the air canister 16 is activated to supply pressurized air to a firing mechanism. As a result, at least one metallic ball projectile is shot.

Exemplary examples of the invention are discussed below.

In a semi-automatic mode, a firing interval is 7 ms in default. An individual may set the firing interval in the range of 1 ms to 20 ms as detailed below.

Pulling the trigger 13. Turning a fire control selector (not shown) from a "SAFE" position to a "SEMI" position. The indicator 14 will flash red light after five (5) seconds. Releasing the trigger 13 to enter a setting mode. Thereafter, the indicator 14 flashes green light for three (3) times prior to stopping flashing. Pulling the trigger 13 at least one time with one flashing of red light per pulling in which one flashing of red light means firing interval increases one (1) millisecond. Releasing the trigger 12. At least one flashing of red light begins after five (5) seconds in which the number of red light flashings means the number of the metallic ball projectile to be shot in the setting. Finally, turning the fire control selector from the "SEMI" position to the "SAFE" position to finish setting.

In a full-automatic mode, a firing rate is 25 bursts per second (bps) in default. An individual may set the firing rate to 15 bps by flashing green light, 20 bps by flashing yellow light, or 25 bps by flashing red light as detailed below.

Pulling the trigger 13. Turning the fire control selector from the "SAFE" position to the "AUTO" position. The indicator 14 will flash red light after five (5) seconds. Releasing the trigger 13 to enter a setting mode. Thereafter, the indicator 14 flashes a color (corresponding to the current one such as red in this example). Pulling the trigger 13 changing the red light flashing (corresponding to 25 bps) to green light flashing (corresponding to 15 bps). A further pulling the trigger 13 changing the green light flashing (corresponding to 15 bps) to yellow light flashing (corresponding to 20 bps). A still further pulling the trigger 13 changing the yellow light flashing (corresponding to 20 bps)

to red light flashing (corresponding to 25 bps). Releasing the trigger 13 and the flashing will stop after five (5) seconds. Finally, turning the fire control selector from the "AUTO" position to the "SAFE" position to finish setting.

While the invention has been described in terms of preferred embodiments, those skilled in the art will recognize that the invention can be practiced with modifications within the spirit and scope of the appended claims.

What is claimed is:

1. An electrically powered air gun, comprising:

a power source;

an indicator, wherein the indicator is used to flash various colors of lights in order to indicate a firing interval;

an air canister;

a solenoid valve for opening or closing the air canister;

an electronic circuit board electrically connected to the power source and including a microswitch and a processor electrically connected to the indicator and the solenoid vale respectively; and a trigger for activating or deactivating the microswitch, wherein the trigger is operatively connected with the indicator and used to change the colors of lights to be flashed by pulling the trigger under a specific firing mode;

wherein, in response to pulling the trigger, a fire control select is turned on to switch to a specific position for setting a semi-automatic mode or a full-automatic mode; and in response to releasing the trigger, a setting mode is entered;

when the trigger is pulled at least one time, the firing interval increases, and the trigger is released at least one time to set up a plurality of ball projectiles to be shot; and when the trigger is set to an inoperative position, a setting of the firing interval is finished.

2. The electrically powered air gun of claim 1, wherein the indicator flashes red light after about five seconds in response to setting to the semi-automatic mode, and the indicator flashes green light for three times for entering the setting mode; pulling the trigger at least one time with one flashing of red light per pulling wherein one flashing of red light represents a firing interval increase of one millisecond, and releasing the trigger to wait about five seconds prior to flashing red light at least one time wherein the number of red light flashes represents the number of the plurality of metallic ball projectiles to be shot.

3. The electrically powered air gun of claim 1, wherein the indicator flashes red light after about five seconds in response to setting to the full-automatic mode, and the indicator flashes a first color light corresponding to a first number bps for entering the setting mode; pulling the trigger to change the first color light flashing to a second color light flashing corresponding to a second number bps, further pulling the trigger to change the second color light flashing to a third color light flashing corresponding to a third number bps, still further pulling the trigger to change the third color light flashing to the first color light flashing, and releasing the trigger to wait for five seconds prior to stop flashing.

* * * * *